US009303920B2

(12) United States Patent
Rivers et al.

(10) Patent No.: US 9,303,920 B2
(45) Date of Patent: Apr. 5, 2016

(54) AIR DIVERTING SYSTEM FOR A SEED DRYING BIN

(71) Applicant: BRATNEY COMPANIES, Des Moines, IA (US)

(72) Inventors: Greggory Owen Rivers, Newton, IA (US); Daryl Dean Walkup, Gower, MO (US)

(73) Assignee: BRATNEY COMPANIES, Des Moines, IA (US)

( * ) Notice: Subject to any disclaimer, the term of this patent is extended or adjusted under 35 U.S.C. 154(b) by 499 days.

(21) Appl. No.: 13/827,608

(22) Filed: Mar. 14, 2013

(65) Prior Publication Data

US 2014/0259722 A1 Sep. 18, 2014

(51) Int. Cl.

| | |
|---|---|
| ***F26B 9/06*** | (2006.01) |
| ***F23L 13/04*** | (2006.01) |
| ***F26B 21/02*** | (2006.01) |
| ***F26B 21/00*** | (2006.01) |

(52) U.S. Cl.

CPC ..... *F26B 9/063* (2013.01); *F23L 13/04* (2013.01); *F26B 21/004* (2013.01); *F26B 21/022* (2013.01); *F26B 2200/06* (2013.01)

(58) Field of Classification Search

CPC ..... F26B 11/00; F26B 11/02; F26B 17/122; F26B 21/02; F26B 21/022; F26B 21/12; F26B 2200/06; F23L 13/00; F23L 13/02; F23L 13/04; F23L 13/06; F23L 13/08; F23L 13/10; F24F 13/10; F16K 1/16; F16K 1/165; F16K 1/18; F16K 1/20; F16K 1/205; F16K 1/2057; F16K 1/2201; F16K 1/2263; F16K 1/30; F16K 11/072; F16K 11/076

See application file for complete search history.

(56) References Cited

U.S. PATENT DOCUMENTS

| | | | | |
|---|---|---|---|---|
| 2,129,505 A * | 9/1938 | Rosenberg | ..... | 126/295 |
| 2,232,981 A * | 2/1941 | Swanson | ..... | 236/45 |
| 2,358,809 A * | 9/1944 | Jennings | ..... | 237/8 R |
| 5,893,218 A * | 4/1999 | Hunter et al. | ..... | 34/492 |
| 6,257,155 B1 * | 7/2001 | Greene | ..... | 110/163 |

* cited by examiner

*Primary Examiner* — David J Laux
(74) *Attorney, Agent, or Firm* — Zarley Law Firm, P.L.C.

(57) ABSTRACT

An air diverting system for a seed dryer bin having a duct connected to and in communication with openings in the seed bin and a fan. An airflow diverter assembly rotatably mounted within the duct and having a handle for rotating the assembly to a desired position.

9 Claims, 3 Drawing Sheets

AIR DIVERTING SYSTEM FOR A SEED DRYING BIN

BACKGROUND OF THE INVENTION

This invention is directed to an air diverting system and more particularly an improved air diverting system for a seed drying bin.

Seed drying bins are well-known in the art. Typically, seed drying bins have an air flow plenum constructed of steel panels that is positioned between a fan and a seed drying chamber. To divert air flow between the top and bottom of the seed chamber a complex device of cables and trap doors is presently used. Not only are the steel panels expensive, but the cables are subject to wear and the device is difficult to install, remove, and replace when a cable breaks. Thus a need exists in the art for a system that addresses these deficiencies.

An objective of the present invention is to provide an air diverting system that is more economical to manufacture.

A further objective of the present invention is to provide an air diverting system that has fewer parts and is easier to install.

These and other objectives will be apparent to one skilled in the art based upon the following written description, drawings, and claims.

SUMMARY OF THE INVENTION

An air diverting system for a seed dryer bin having a duct connected to and in communication with openings in a seed bin and a fan. Rotatably mounted within the duct is an air diverter assembly that is operatively connected to a handle for moving the assembly to a desired position.

DETAILED DESCRIPTION OF THE PREFERRED EMBODIMENTS

Figure 1:
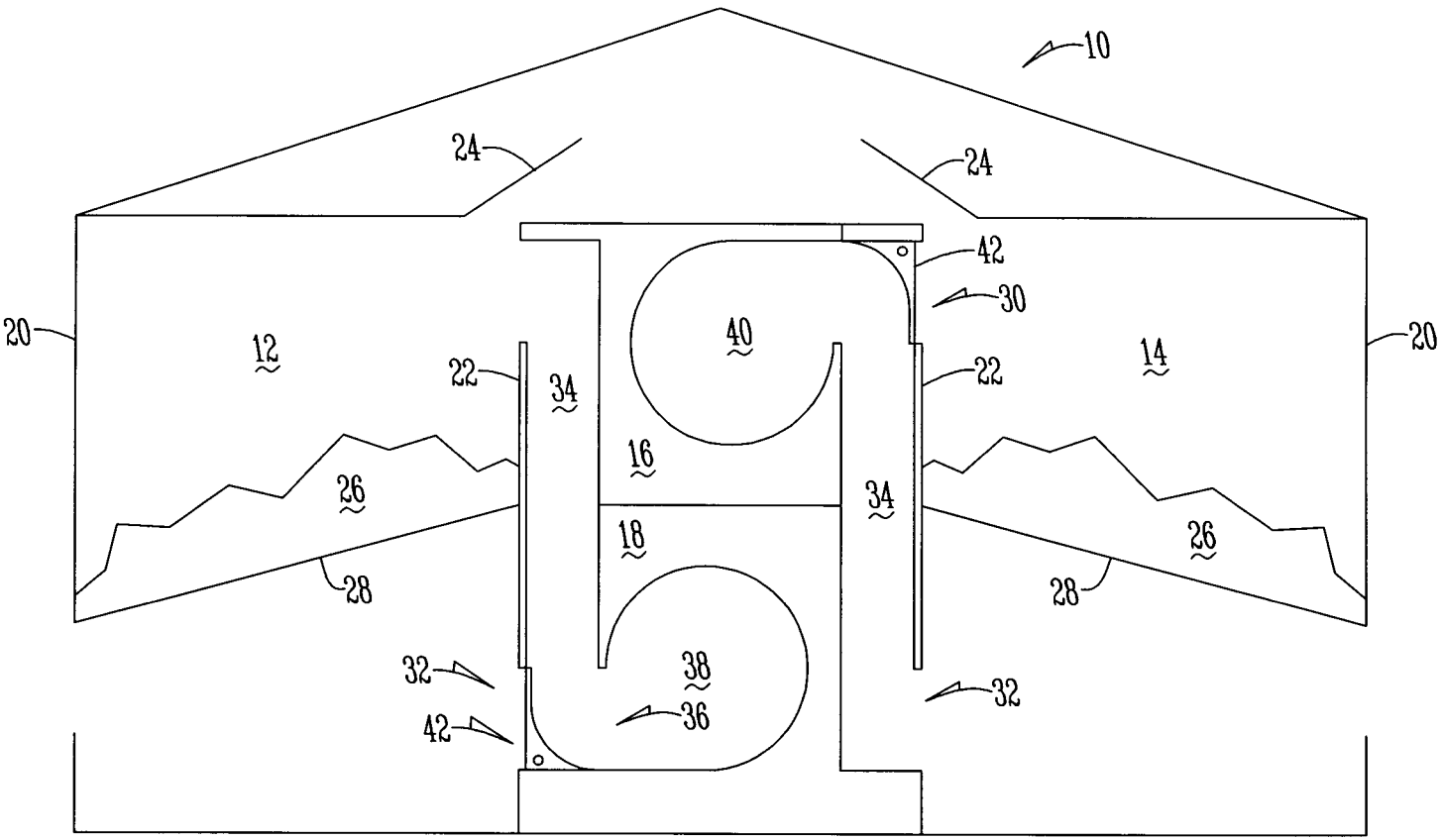
FIG. 1 is a side sectional view of an air diverting system.
Figure 2:
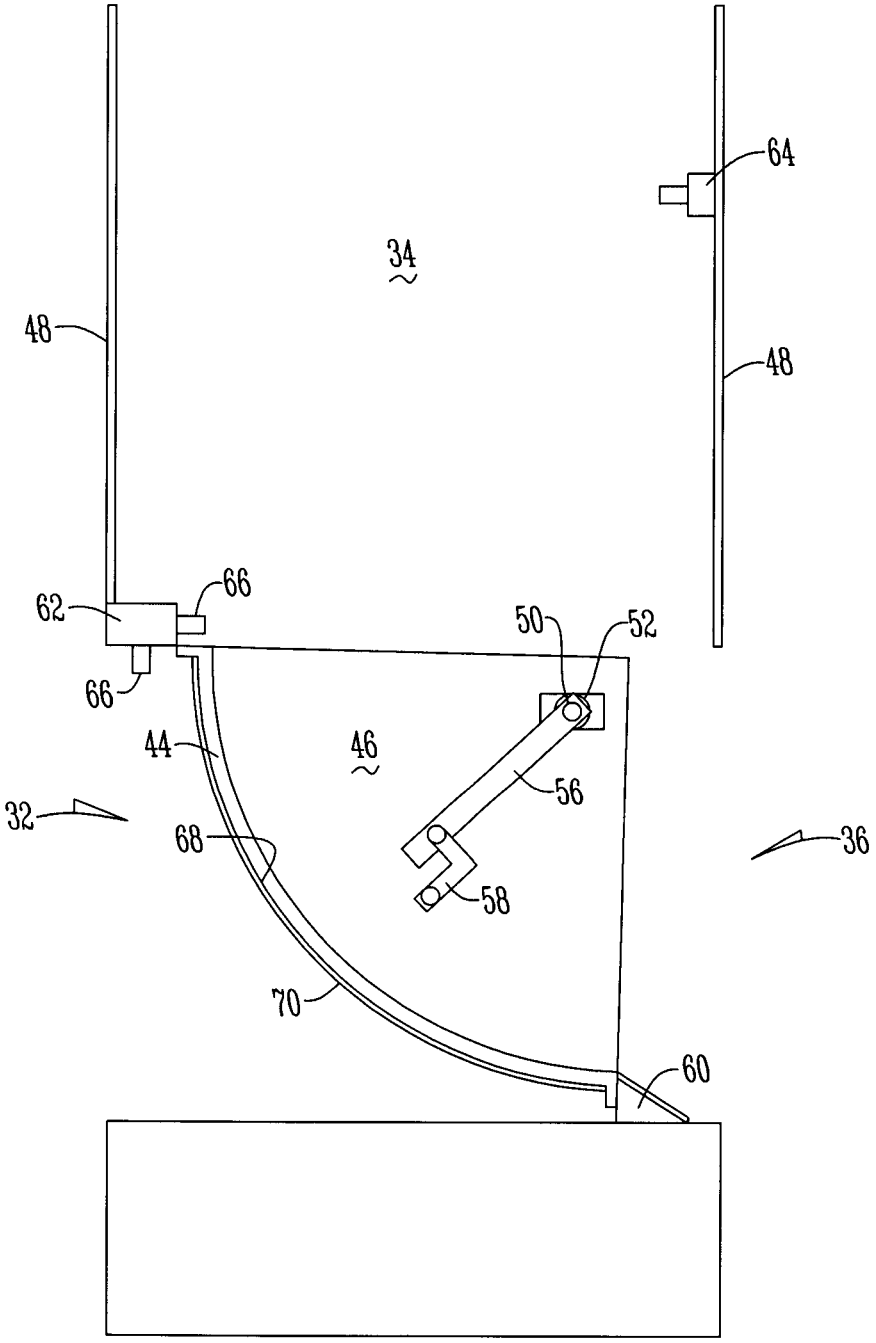
FIG. 2 is a side sectional view of an air diverting system.
Figure 3:
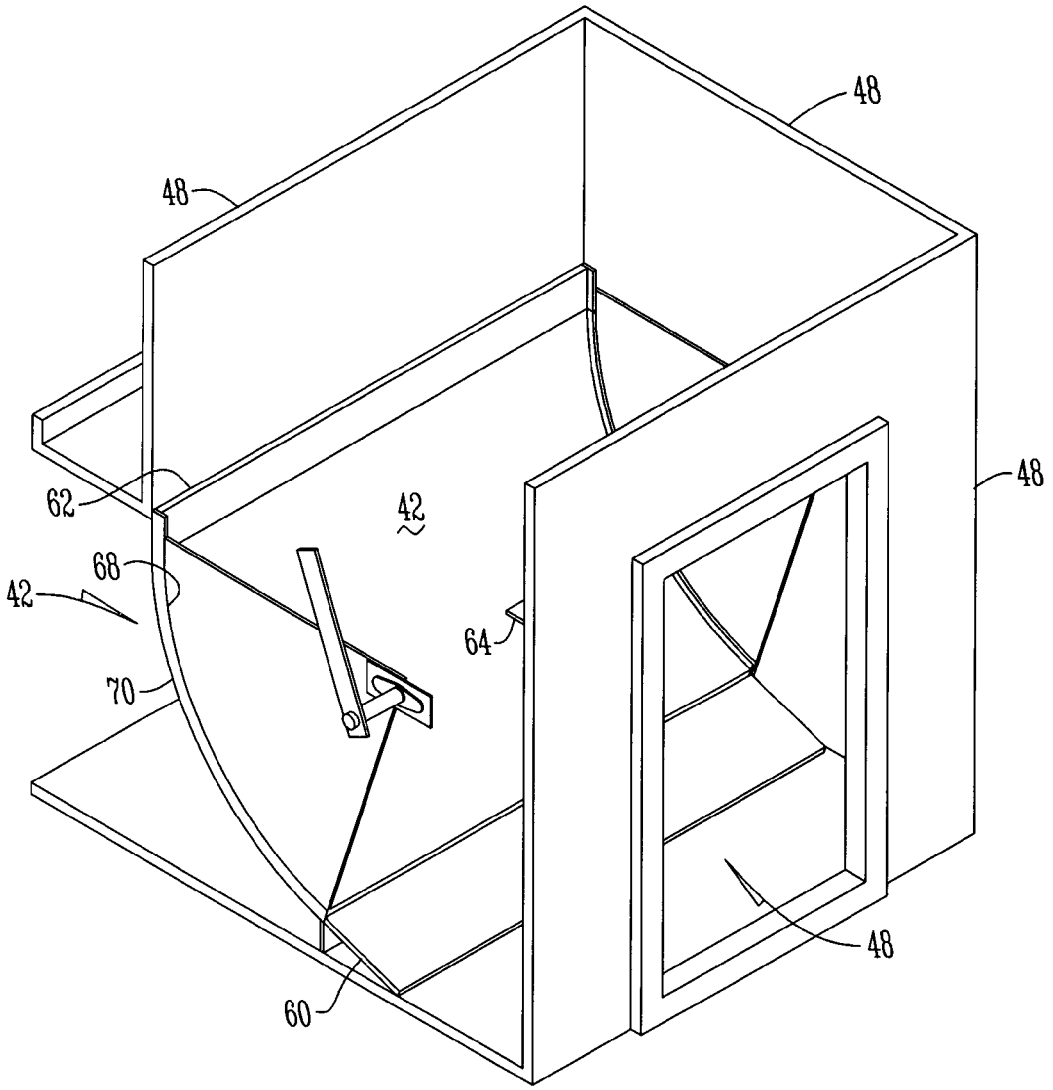
FIG. 3 is a perspective view of an air diverting assembly.

Referring to the Figures, a seed dryer 10 has opposing bins 12 and 14 that are separated by an upper plenum 16 and a lower plenum 18. Each bin 12 and 14 has an outside wall 20, an inside wall 22 and a top door 24 used to fill the bins with seed 26. Within each bin 12 and 14 is slanted air permeable floor 28 that are perforated/grated such that seed 26 will not pass through but air will.

On the inside wall 22 of each bin 12 and 14 is an upper and a lower opening 30 and 32 that are connected to and in communication with a duct 34. On the side opposite the inside wall 22, the duct has an intake opening 36 that is connected to and in communication with fans 38 and 40. As an example only, bin 12 is connected to fan 38, which resides in lower plenum 18, by duct 34 and bin 14 is connected to fan 40 which resides in upper plenum 16 by duct 34.

Disposed within and mounted to duct 34 is an air flow diverter assembly 42. Preferably, the diverter assembly is positioned adjacent to intake opening 36. The diverter assembly 42 has an air diverting wall 44 and a pair of sidewalls 46. The air diverting wall 44 is of any shape and preferably has a generally concave arcuate shape. The sidewalls 46 are pivotally mounted to walls 48 in duct 34 by a stub shaft 50 that extends through a pivot bearing 52 mounted in openings 54 in walls 48. A handle 56 is connected to at least one stub shaft 50 outside of duct 34. Alternatively, a motor (not shown) is connected to the stub shaft 50. Mounted to wall 48 adjacent handle 56 is a locking mechanism 58 that retains handle 56 in a desired position.

In one embodiment, mounted to the interior of the duct 34 is a first stop 60, a strike bar 62, and a second stop 64. Each of the stops 60 and 64 and the strike bar 62 have seals 66 attached thereto. In addition, on the interior of wall 48 and on a corner edge 68 of the diverter assembly 42 are aligned strips 70 of slidable material such as UHMW polyethylene that allows the diverter assembly 42 to slide in relation to wall 48.

In operation, when fans 38 and 40 are activated, air is blown through intake opening 36 to the diverter assembly 42. When the diverter assembly 42 is in a raised or first position, air flows through lower opening 30 into bin 12 and through upper opening 32 into bin 14. When in the raised position, back edge 72 of diverter wall 44 engages second stop 64 while front edge 74 engages strike bar 62 to seal duct 34.

To change the direction of air flow the diverter assembly 42 is rotated by handle 56 or motor to a lowered or second position. In the second position air flow is diverted from fan 68 through opening 30 and into bin 12 and from fan 70 through opening 32 into bin 14. When in the second position the front edge 74 of wall 44 engages first stop 60 and the back edge 72 engages strike bar 62 to seal duct 34.

Accordingly an air flow diverter for a seed bin dryer has been disclosed that, at the very least, meets all of the stated objectives.

What is claimed is:

1. A flow diverting assembly for diverting air flow in a duct of a seed dryer, comprising:

an air diverting wall connected to a pair of sidewalls;

rotatable stub shafts connected to the sidewalls that extend through a wall of an air duct; and a handle connected to at least one stub shaft, wherein a first stop, a second stop, and a strike bar are mounted to the wall of the duct and positioned to engage the air diverting wall in selected positions.

2. The assembly of claim 1 wherein a locking mechanism is mounted to the duct and positioned to hold the handle in a desired position.

3. The system of claim 1 wherein seals are connected to the first stop, the second stop, and the strike bar.

4. The system of claim 1 wherein aligned strips of material are positioned on a corner edge of the diverter assembly and the wall of the duct.

5. A drying system for a seed dryer bin, comprising:

a seed bin having an upper and lower opening in an inside wall;

a duct connected to and in communication with the upper and lower openings;

a fan connected to and in communication with an intake opening in the duct; and an air flow diverter assembly positioned within and pivotally mounted to the duct, wherein the diverter assembly has an air diverting wall and sidewalls pivotally connected to a wall of the duct and a first stop, a second stop and a strike bar are mounted to the wall in the duct and positioned to engage the air diverting wall in selected positions.

6. The system of claim 5 wherein a handle is operatively connected to the diverter assembly for moving the diverter assembly to a desired position.

7. The system of claim 6 wherein a locking mechanism is mounted to the duct and positioned to hold the handle in a desired position.

8. The system of claim 5 wherein seals are connected to the first stop, the second stop, and the strike bar.

9. The system of claim 1 wherein aligned strips of material are positioned on a corner edge of the diverter assembly and the wall of the duct.

* * * * *